US005883360A

United States Patent [19]

Tatematsu et al.

[11] Patent Number: 5,883,360

[45] Date of Patent: Mar. 16, 1999

[54] CERAMIC HEATER CERAMIC GLOW PLUG AND METHOD OF MANUFACTURING THE CERAMIC HEATER

[75] Inventors: Kazuho Tatematsu; Masahiro Konishi, both of Aichi, Japan

[73] Assignee: NGK Spark Plug Co., Ltd., Japan

[21] Appl. No.: 60,474

[22] Filed: Apr. 15, 1998

[30] Foreign Application Priority Data

Apr. 22, 1997 [JP] Japan ..... 9-104394

[51] Int. Cl.[6] ..... F23Q 7/22

[52] U.S. Cl. ..... 219/270; 219/267; 219/268; 219/269; 219/552; 219/553; 219/544

[58] Field of Search ..... 219/270, 269, 219/268, 267, 552, 553, 544; 501/97, 87, 92

[56] References Cited

U.S. PATENT DOCUMENTS

| | | | |
|---|---|---|---|
| 4,486,651 | 12/1984 | Atsumi et al. | 219/553 |
| 4,549,905 | 10/1985 | Yamaguchi et al. | 75/238 |
| 4,556,780 | 12/1985 | Atsumi et al. | 219/270 |
| 4,725,711 | 2/1988 | Minegishi et al. | 219/270 |
| 4,912,305 | 3/1990 | Tatemasu et al. | 219/544 |
| 5,130,055 | 7/1992 | Yasutomi et al. | 252/518 |
| 5,233,166 | 8/1993 | Maeda et al. | 219/552 |
| 5,304,778 | 4/1994 | Dasgupta et al. | 219/270 |
| 5,439,855 | 8/1995 | Rosenthal | 501/97.4 |
| 5,663,865 | 9/1997 | Kawada et al. | 361/234 |

FOREIGN PATENT DOCUMENTS

| | | |
|---|---|---|
| 5-1817 | 1/1993 | Japan . |
| 5-174948 | 7/1993 | Japan . |
| 5-234665 | 9/1993 | Japan . |
| 6-251862 | 9/1994 | Japan . |

*Primary Examiner*—Teresa Walberg
*Assistant Examiner*—Vinod D Patel
*Attorney, Agent, or Firm*—Brinks Hofer Gilson & Lione

[57] ABSTRACT

A ceramic heater includes a silicon nitride ceramic and a heating element embedded in the ceramic. The heating element is formed through use of, as a main component, a silicide, carbide, or nitride of at least one element selected from the group consisting of W, Ta, Nb, Ti, Mo, Zr, Hf, V, and Cr. The ceramic includes, as sintering aids, 1 to 20% by weight of at least one rare earth element calculated as an oxide thereof; 0.5 to 8% by weight of V (vanadium) calculated as $V_2O_5$, and, 0.5 to 8% by weight of at least one Va/VIa group element selected from the group consisting of Nb, Ta, Cr, Mo, and W calculated as an oxide thereof. The proportion in total of vanadium and the Va/VIa element is 1 to 10% by weight calculated as oxides. The ceramic heater has excellent high-temperature strength and acid resistance.

17 Claims, 3 Drawing Sheets

CERAMIC HEATER CERAMIC GLOW PLUG AND METHOD OF MANUFACTURING THE CERAMIC HEATER

BACKGROUND OF THE INVENTION

1. Field of the Invention

The present invention relates to a ceramic heater suitable for a ceramic glow plug disposed in diesel engines, as well as to the ceramic glow plug. The present invention also relates to a method of manufacturing such a ceramic heater.

2. Description of the Related Art

In manufacture of a conventional silicon-nitride ceramic heater including a heating element embedded in a ceramic that contains silicon nitride as a main component, $Al_2O_3$—$Y_2O_3$ and oxides of rare earth elements have been used as sintering aids (Japanese Patent Application Laid-Open (kokai) Nos. 5-1817, 5-174948, 5-234665, and others).

The present inventors experimentally manufactured the above-mentioned conventional ceramic heaters and tested them to discover the following disadvantages:

A silicon-nitride ceramic manufactured through use of $Al_2O_3$—$Y_2O_3$ as a sintering aid has poor high-temperature strength and acid-resistance.

A silicon-nitride ceramic heater manufactured through use of an oxide of a rare earth element as a sintering aid is superior to the silicon-nitride ceramic heater manufactured through use of $Al_2O_3$—$Y_2O_3$ as a sintering aid in terms of both high-temperature strength and acid resistance. However, the acid resistance of the silicon-nitride ceramic heater manufactured through use of an oxide of a rare earth element is insufficient in the case where the temperature of the ceramic heater is increased to a temperature as high as 1400° C. in order to improve ease of starting an engine.

SUMMARY OF THE INVENTION

A first object of the present invention is to provide a ceramic heater which has excellent high-temperature strength and acid resistance.

A second object of the present invention is to provide a ceramic glow plug which has excellent high-temperature strength and acid resistance and which incorporates the aforementioned ceramic heater.

A third object of the present invention is to provide a method of manufacturing a ceramic heater as mentioned above in connection with the first object.

To achieve the above objects, according to a first aspect of the present invention, there is provided a ceramic heater which includes a heating element embedded in a ceramic that contains silicon nitride as a main component. The heating element is formed through use of, as a main component, a silicide, carbide, or nitride of at least one element selected from the group consisting of W, Ta, Nb, Ti, Mo, Zr, Hf, V, and Cr, the ceramic including, as sintering aids:

1 to 20% by weight of at least one rare earth element calculated as an oxide thereof;

0.5 to 8% by weight of V (vanadium) calculated as $V_2O_5$; and 0.5 to 8% by weight of at least one Va/VIa group element selected from the group consisting of Nb, Ta, Cr, Mo, and W calculated as an oxide thereof, wherein the proportion in total of vanadium and the Va/VIa element is 1 to 10% by weight calculated as oxides.

As used herein, all percentages are with respect to the total weight of ceramic.

Preferably, the amount of the at least one rare earth element is 1 to 15% by weight calculated as an oxide thereof.

Preferably, the amount of V (vanadium) is 1 to 5% by weight calculated as $V_2O_5$.

Preferably, the amount of the at least one Va/VIa group element is 1 to 5% by weight calculated as an oxide thereof.

Preferably, the proportion in total of vanadium and the Va/VIa element is 2 to 6% by weight calculated as oxides.

According to a second aspect of the present invention, there is provided a ceramic glow plug which comprises the above-mentioned ceramic heater.

According to a third aspect of the present invention, there is provided a method of manufacturing a ceramic heater, comprising the steps of:

preparing granules containing, as a main component, a silicide, carbide, or nitride of at least one element selected from the group consisting of W, Ta, Nb, Ti, Mo, Zr, Hf, V, and Cr;

subjecting the granules, together with connection lead wires, to a molding process so as to obtain an unfired heating element;

preparing a powdery mixture containing silicon nitride and, as sintering aids, 1 to 20% by weight of at least one rare earth element calculated as an oxide thereof, 0.5 to 8% by weight of V (vanadium) calculated as $V_2O_5$, and 0.5 to 8% by weight of at least one Va/VIa group element selected from the group consisting of Nb, Ta, Cr, Mo, and W calculated as an oxide thereof, the proportion in total of vanadium and the Va/VIa element being 1 to 10% by weight calculated as oxides;

embedding the unfired heating element into the powdery mixture;

forming into a desired shape the powdery mixture containing the heating element;

firing the shaped mixture to obtain a sintered body; and grinding the sintered body such that the connecting lead wires are partially exposed.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE INVENTION AND PREFERRED EMBODIMENT

Figure 1:
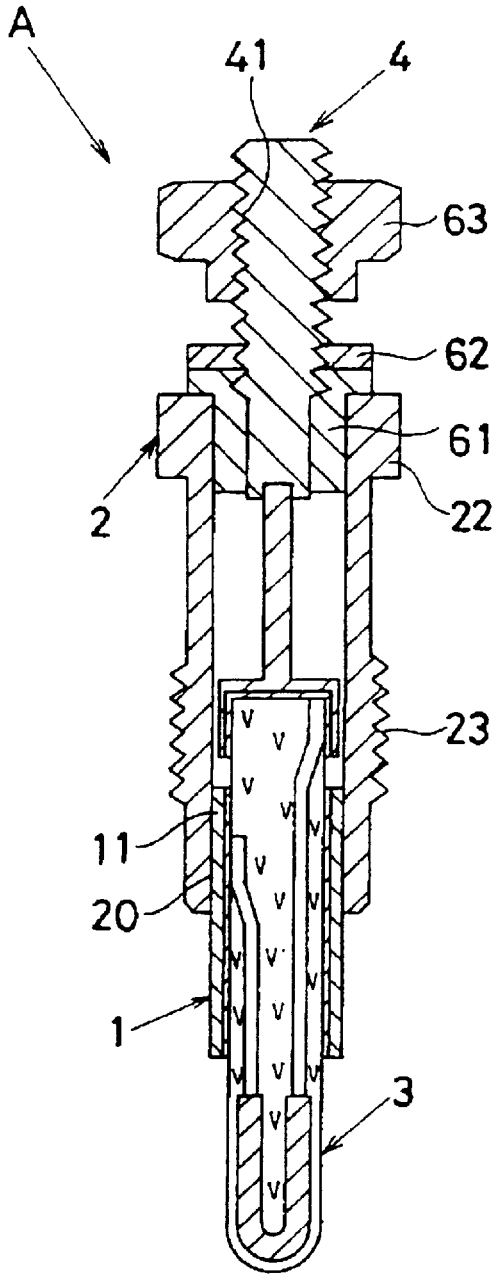
FIG. 1 is a sectional view of a glow plug comprising a ceramic heater according to the present invention.

In the ceramic heater according to the present invention, the heating element is formed through use of, as a main component, a silicide, carbide, or nitride of at least one element selected from the group consisting of W, Ta, Nb, Ti, Mo, Zr, Hf. V, and Cr, and is embedded in a silicon nitride ceramic.

The ceramic of the ceramic heater includes, as sintering aids, 1 to 20% by weight of at least one rare earth element calculated as an oxide thereof, 0.5 to 8% by weight of V (vanadium) calculated as $V_2O_5$, and 0.5 to 8% by weight of at least one Va/VIa group element selected from the group consisting of Nb, Ta, Cr, Mo, and W calculated as an oxide thereof. The proportion in total of vanadium and the Va/VIa element is 1 to 10% by weight calculated as oxides.

The ceramic heater of the present invention has excellent mechanical strength (in the temperature range from ambient temperature to high temperature) and excellent acid resistance, although the specific mechanism for this is unknown.

If the rare earth element is contained in an amount less than 1% by weight calculated as oxide thereof, it cannot serve as a sintering aid, whereas if the rare earth element is contained in an amount of more than 20% by weight calculated as oxide, the mechanical strength of the sintering body is lowered. In addition, the higher the content of the rare earth element, the greater the amount of melilite compound ($R_2Si_3O_3N_4$, where R is a rare earth element), which has a harmful effect on resistance to low-temperature oxidation at 700°–1000° C., with the result that the acid resistance of the ceramic heater is lowered. Accordingly, the content of the rare earth element must be less than 20% by weight calculated as oxide thereof.

Preferably, the content of the at least one rare earth element is 1 to 15% by weight calculated as an oxide thereof.

The proportion in total of vanadium and the Va/VIa element is 1 to 10% by weight calculated as oxide. The reason for this is as follows:

If the above-mentioned proportion in total weight is less than 1% by weight calculated as oxide, vanadium and the Va/VIa element cannot serve as sintering aids.

If the above-mentioned proportion in total weight is more than 10% by weight calculated as oxide, excess grain boundary phases are rendered, the disperse phases (of hydrosulfides and the like) do not uniformly disperse, and the elements coagulate to lower the high-temperature strength.

Preferably, the proportion in total of vanadium and the Va/VIa element is 2 to 6% by weight calculated as oxides.

The content of vanadium and the content of the at least one Va/VIa group element are both determined to fall within the range of 0.5 to 8% by weight calculated as oxide. This is because if the content is less than 0.5% by weight or more than 8% by weight, synergism rendered through addition of a mixture of a plurality of sintering aids cannot be obtained.

Preferably, the content of V (vanadium) is 1 to 5% by weight calculated as $V_2O_5$, and the content of the at least one Va/VIa group element is 1 to 5% by weight calculated as an oxide thereof.

Since the ceramic heater of the present invention has excellent mechanical strength (in the temperature range of ambient temperature to high temperature) and excellent acid resistance, a ceramic glow plug that is manufactured through use of the ceramic heater of the present invention exhibits excellent high-temperature strength and acid resistance when used in an engine.

An embodiment of the present invention will next be described with reference to the drawings.

As shown in FIG. 1, a glow plug A comprises a metallic outer sleeve 1; a cylindrical body member 2 that holds a rear portion 11 of the metallic outer sleeve 1; a ceramic heater 3 inserted into the metallic outer sleeve 1; and a terminal electrode 4 disposed in the body member 2 in an insulated manner.

The metallic outer sleeve 1 (wall thickness: 0.6 mm) is made of a heat-resistant metal and its rear portion 11 is silver-alloy brazed onto the inner wall 20 of the tip end of the body member 2.

The body member 2 (made of carbon steel) has a hexagonal portion 22 at its rear end for engagement of a wrench. A thread 23 is formed on the outer periphery of the front end of the body member 2 for screw attachment to a cylinder block of a diesel engine.

Figure 2:
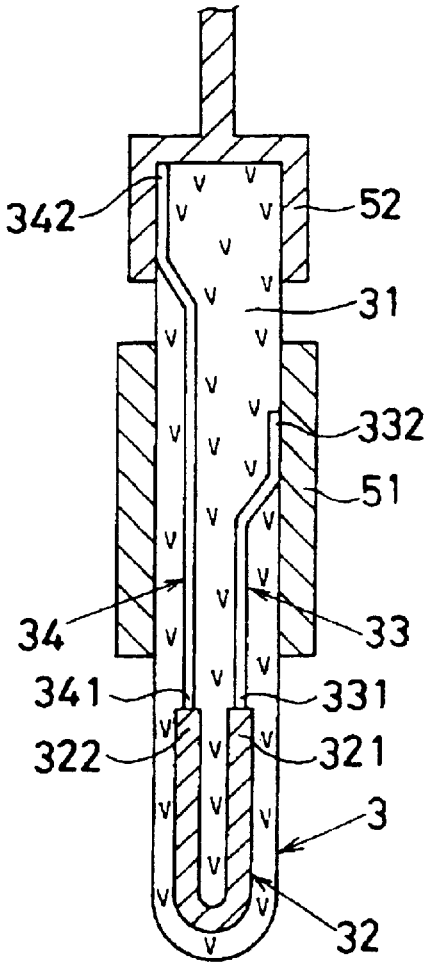
FIG. 2 is a sectional view of the ceramic heater according to the present invention.

As shown in FIG. 2, in accordance with a method as described blow, the ceramic heater 3 is manufactured such that connection lead wires 33 and 34 and a U-shaped heat-generating resistor element 32 are embedded in a ceramic 31 made of mainly $Si_3N_4$. The resistance (design value) between the connection lead wires 33 and 34 is 750 mΩ.

The heat-generating resistor element 32 is embedded in the ceramic 31 so as to be located at least 0.3 mm from the surface. The heat-generating resistor element 32 is designed to be heated to 800°–1300° C.

The connection lead wires 33 and 34 are formed of W (tungsten) wire having a diameter of 0.3 mm. The first ends 331 and 341 of the lead wires 33 and 34 are respectively connected to the end portions 321 and 322 of the heat-generating resistor element 32, whereas the second ends 332 and 342 of the lead wires 33 and 34 are respectively exposed from the surface of the ceramic at intermediate and rear positions.

The second end 332 of the connection lead wire 33 is electrically connected to the body member 2 through a metallic tube 51 and the metallic outer sleeve 1 (see FIG. 2).

The second end 342 of the connection lead wire 34 is electrically connected to the terminal electrode 4 through a metallic cap member 52.

As shown in FIG. 1, the terminal electrode 4 having a thread 41 is fixed to the body member 2 in an insulated manner through use of an insulator 61 and a nut 62 . Numeral 63 denotes a nut for fixing a power supply metal piece (not shown) to the terminal electrode 4.

The method for manufacturing the ceramic heater 3 will next be described.

(1) 40% by weight of silicon nitride having a mean grain size of 0.7 μm and 5% by weight of $Yb_2O_3$ are added to WC (tungsten carbide) having a mean grain size of 0.5 μm. The resultant mixture is wet-mixed for 50 hours, to thereby produce a slurry.

Instead of WC (tungsten carbide), silicide, carbide, or nitride of one or more elements selected from the group consisting of W, Ta, Nb, Ti, Mo, Zr, Hf, V, and Cr may be used (for example, MoSi (molybdenum disulfide)).

(2) The slurry is dried for 12 hours at 150° C. to form powder.

(3) To the powder, several types of binders are added in an amount of 30 to 70% by volume and the resultant mixture is kneaded in a kneader for three hours. Examples of such binders include polyethylene and a mixture of wax, vinyl acetate, and polyethylene (synthetic resin binder).

(4) Through use of a pelletizer, the kneaded mixture is palletized in granules having a diameter of approximately 3 mm.

Figure 3:
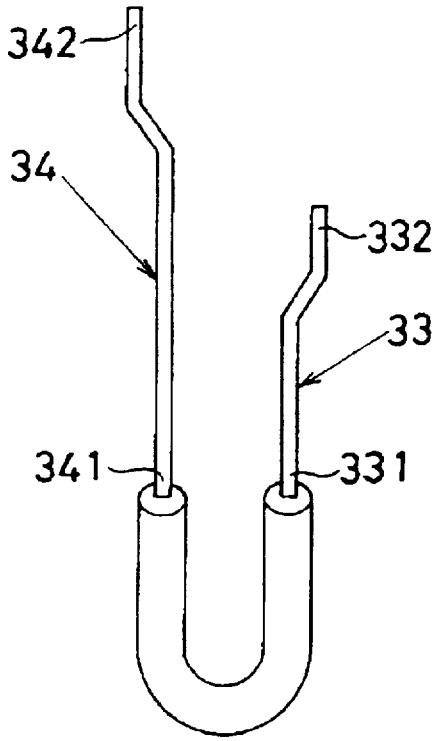
FIG. 3 is a perspective view of an unfired heat-generating resistor element.

(5) The granules are charged into a die of an injection molding machine in which the connection lead wires 33 and 34 have been placed in advance. Through a molding process, there is obtained an unfired heat-generating resistor element that has a three-dimensional shape of the letter U, as shown in FIG. 3.

TABLE 1

| | | COMPOSITIONS (wt. %) | | | | | | TEST RESULTS | | | |
|---|---|---|---|---|---|---|---|---|---|---|---|
| | | | | | | | | Three-point bending strength (Mpa) | | Increase in amount of oxidation ($mg/cm^2$) | |
| | | $Si_3N_4$ | Oxide of rare earth element | | $V_2O_5$ | Oxide of Va/VIa group element | | Room Temp. | 1400° C. | 900° C. × 100 h | 1400° C. × 100 h |
| Example | 1 | 83.0 | $Yb_2O_3$ | 14.0 | 1.0 | $Nb_2O_5$ | 2.0 | 1320 | 820 | 0.03 | 0.3 |
| | 2 | 83.5 | $Er_2O_3$ | 9.0 | 3.0 | $Ta_2O_5$ | 4.5 | 1280 | 840 | 0.03 | 0.2 |
| | 3 | 87.0 | $Yb_2O_3$ | 6.0 | 5.0 | $Cr_2O_3$ | 2.0 | 1260 | 870 | 0.02 | 0.3 |
| | 4 | 85.0 | $Er_2O_3$ | 8.0 | 2.0 | $MoO_3$ | 5.0 | 1340 | 830 | 0.03 | 0.2 |
| | 5 | 82.5 | $Yb_2O_3$ | 12.0 | 4.0 | $WO_3$ | 1.5 | 1350 | 830 | 0.04 | 0.2 |
| | 6 | 86.0 | $Er_2O_3$ | 5.0 | 2.0 | $Cr_2O_3$ | 2.0 | 1300 | 830 | 0.02 | 0.2 |
| | | | $Yb_2O_3$ | 5.0 | | | | | | | |
| | 7 | 83.0 | $Er_2O_3$ | 10.0 | 4.0 | $Ta_2O_5$ | 1.5 | 1270 | 820 | 0.04 | 0.2 |
| | | | | | | $WO_3$ | 1.5 | | | | |
| Comparative Example | 8 | 88.0 | $Yb_2O_3$ | 8.0 | 4.0 | | 0 | 1200 | 700 | 0.06 | 0.4 |
| | 9 | 76.0 | $Er_2O_3$ | 12.0 | 2.0 | $Nb_2O_5$ | 10.0 | 1060 | 540 | 0.07 | 0.6 |
| | 10 | 82.0 | $Yb_2O_3$ | 14.0 | 0 | $MoO_3$ | 4.0 | 1270 | 680 | 0.08 | 0.6 |
| | 11 | 80.0 | $Er_2O_3$ | 7.0 | 11.0 | $Ta_2O_5$ | 2.0 | 1120 | 670 | 0.06 | 0.5 |
| | 12 | 81.0 | $Yb_2O_3$ | 5.5 | 6.5 | $WO_3$ | 7.0 | 940 | 720 | 0.06 | 0.6 |
| | 13 | 70.0 | $Er_2O_3$ | 23.0 | 2.0 | $Cr_2O_3$ | 5.0 | 1050 | 730 | 0.10 | 0.8 |

(6) Silicon nitride granules having a mean grain size of 0.7 μm, a rare earth element having a mean grain size of 1–2 μm, and powder of an oxide of a Va/VIa group element (i.e. $V_2O_5$, $Nb_2O_5$, $Ta_2O_5$, $Cr_2O_3$, $MoO_3$, $WO_3$) having a mean grain size of 0.5–3 μm are mixed in proportions shown in Table 1 and subjected to wet-mixing in a ball mill. Subsequently, binders are added to the mixture, which is then spray-dried to yield a powdery mixture.

(7) The unfired heat-generating resistor element (shown in FIG. 3) manufactured as aforementioned is embedded in the aforementioned powdery mixture, which is press-formed and then fired in accordance with a hot press firing method (in a nitrogen gas atmosphere, 1750° C.×60 min, 300 $kgf/cm^2$), to thereby obtain a sintered body.

(8) The sintered body is ground into a generally cylindrical shape having a diameter of 3.5 mm. As a result, the second ends 332 and 342 of the connection lead wires 33 and 34 are exposed. The metallic tube 51 and the metallic cap 52 are respectively brazed to the second ends 332 and 342 of the connection lead wires 33 and 34, to thereby complete a ceramic heater 3 shown in FIG. 2.

The glow plug A is produced through the following process.

The metallic tube 51 and the metallic cap member 52 are inserted in the metallic outer sleeve 1, and the rear portion 11 of the metallic outer sleeve 1 is silver-alloy brazed to the inner wall 20 of the front end of the body member 2.

Further, the terminal electrode 4 is fixed to the body member 2 via the insulator 61 and the nut 62.

The following tests were conducted with regard to ceramic heaters ((1)–(7)) of the present invention and comparative ceramic heaters ((8)–(3)) which had been manufactured according to the above-described method. The test results are shown in Table-1.

In order to evaluate the mechanical strength of the ceramic heaters of the present invention and the comparative ceramic heaters, three-point bending strength (MPa) was measured at ambient temperature and high temperature (1400° C.)

In order to evaluate the acid resistance of the ceramic heaters of the present invention and the comparative ceramic heaters, the heaters were allowed to stand in a furnace at 900° C. and 1400° C. for 100 hours each and the increased amount of oxidation ($mg/cm^2$) was measured.

As clearly shown in Table-1, the ceramic heaters of the present invention ((1)–(7)) were confirmed to be superior to the comparative ceramic heaters in terms of both mechanical strength (at ambient temperature and high temperature) and acid resistance.

Glow plugs comprising the ceramic heaters ((1)–(7)) of the present invention and glow plugs comprising, the comparative ceramic heaters ((8)–(13)) were disposed in an engine, and a cycle operation in the range of 400° to 900° C. was conducted in order to evaluate mechanical strength and acid resistance. The test results demonstrate that the glow plugs comprising the ceramic heaters ((1)–(7)) of the present invention are superior to the glow plugs comprising the comparative ceramic heaters ((8)–(13)) in terms of both mechanical strength and acid resistance.

The present disclosure relates to subject matter contained in Japanese patent Application No. 104394/97, filed on Apr. 22, 1997, which is expressly incorporated herein by reference in its entirety.

Obviously, numerous modifications and variations of the present invention are possible in light of the above teachings. It is therefore to be understood that within the scope of the appended claims, the present invention may be practiced otherwise than as specifically described herein.

What is claimed is:

1. A ceramic heater comprising a ceramic that contains silicon nitride as a main component, and a heating element embedded in said ceramic, said heating element being formed through use of, as a main component, a silicide, carbide, or nitride of at least one element selected from the group consisting of W, Ta, Nb, Ti, Mo, Zr, Hf, V, and Cr; and said ceramic including, as sintering aids:

1 to 20% by weight of at least one rare earth element calculated as an oxide thereof;

0.5 to 8% by weight of V (vanadium) calculated as $V_2O_5$; and 0.5 to 8% by weight of at least one Va/VIa group element selected from the group consisting of Nb, Ta, Cr, Mo, and W calculated as an oxide thereof, wherein the proportion in total of vanadium and the Va/VIa element is 1 to 10% by weight calculated as oxides.

2. The ceramic heat according to claim 1, wherein the amount of said at least one rare earth element is 1 to 15% by weight calculated as an oxide thereof.

3. The ceramic heat according to claim 1, wherein the amount of V (vanadium) is 1 to 5% by weight calculated as $V_2O_5$.

4. The ceramic heat according to claim 1, wherein the amount of said at least one Va/ VIa group element is 1 to 5% by weight calculated as an oxide thereof.

5. The ceramic heat according to claim 1, wherein the proportion in total of vanadium and the Va/VIa element is 2 to 6% by weight calculated as oxides.

6. The ceramic heat according to claim 1, wherein the amount of said at least one rare earth element is 1 to 15% by weight calculated as an oxide thereof; the amount of V (vanadium) is 1 to 5% by weight calculated as $V_2O_5$; the amount of said at least one Va/VIa group element is 1 to 5% by weight calculated as an oxide thereof; and the proportion in total of vanadium and the Va/VIa element is 2 to 6% by weight calculated as oxides.

7. A method of manufacturing a ceramic heater, comprising the steps of:

preparing granules containing, as a main component, a silicide, carbide, or nitride of at least one element selected from the group consisting of W, Ta, Nb, Ti, Mo, Zr, Hf, V, and Cr;

subjecting the granules, together with connection lead wires, to a molding process so as to obtain an unfired heating element;

preparing a powdery mixture containing silicon nitride and, as sintering aids, 1 to 20% by weight of at least one rare earth element calculated as an oxide thereof, 0.5 to 8% by weight of V (vanadium) calculated as $V_2O_5$, and 0.5 to 8% by weight of at least one Va/VIa group element selected from the group consisting of Nb, Ta, Cr, Mo, and W calculated as an oxide thereof, the proportion in total of vanadium and the Va/VIa element being 1 to 10% by weight calculated as oxides;

embedding the unfired heating element into the powdery mixture;

forming into a desired shape the powdery mixture containing the heating element;

firing the shaped mixture to obtain a sintered body; and grinding the sintered body such that the connecting lead wires are partially exposed.

8. The method of manufacturing a ceramic heater according to claim 7, wherein the amount of said at least one rare earth element is 1 to 15% by weight calculated as an oxide thereof.

9. The method of manufacturing a ceramic heater according to claim 7, wherein the amount of V (vanadium) is 1 to 5% by weight calculated as $V_2O_5$.

10. The method of manufacturing a ceramic heater according to claim 7, wherein the amount of said at least one Va/VIa group element is 1 to 5% by weight calculated as an oxide thereof.

11. The method of manufacturing a ceramic heater according to claim 7, wherein the proportion in total of vanadium and the Va/VIa element is 2 to 6% by weight calculated as oxides.

12. The method of manufacturing a ceramic heater according to claim 7, wherein the amount of said at least one rare earth element is 1 to 15% by weight calculated as an oxide thereof; the amount of V (vanadium) is 1 to 5% by weight calculated as $V_2O_5$; the amount of said at least one Va/VIa group element is 1 to 5% by weight calculated as an oxide thereof; and the proportion in total of vanadium and the Va/VIa element is 2 to 6% by weight calculated as oxides.

13. A ceramic glow plug comprising:

a ceramic heater comprising a ceramic that contains silicon nitride as a main component, and a heating element embedded in said ceramic, said heating element being formed through use of, as a main component, a silicide, carbide, or nitride of at least one element selected from the group consisting of W, Ta, Nb, Ti, Mo, Zr, HF, V, and Cr; and said ceramic including, as sintering aids: 1 to 20% by weight of at least one rare earth element calculated as an oxide thereof;

0.5 to 8% by weight of V (vanadium) calculated as $V_2O_5$; and 0.5 to 8% by weight of at least one Va/VIa group element selected from the group consisting of Nb, Ta, Cr, Mo, and W calculated as an oxide thereof wherein the proportion in total of vanadium and the Va/VIa element is 1 to 10% by weight calculated as oxides.

14. The ceramic glow plug according to claim 13 wherein the amount of said at least one rare earth element is 1 to 15% by weight calculated as an oxide thereof; the amount of V (vanadium) is 1 to 5% by weight calculated as $V_2O_5$; the amount of said at least one Va/VIa group element is 1 to 5% by weight calculated as an oxide thereof; and the proportion in total of vanadium and the Va/VIa element is 2 to 6% by weight calculated as oxides.

15. A method of manufacturing a ceramic glow plug comprising the steps of:

producing a ceramic heater by:

preparing granules containing, as a main component, a silicide, carbide, or nitride of at least one element selected from the group consisting of W, Ta, Nb, Ti, Mo, Zr, Hf, V, and Cr;

subjecting the granules, together with connection lead wires, to a molding process so as to obtain an unfired heating element;

preparing a powdery mixture containing silicon nitride and, as sintering aids, 1 to 20% by weight of at least one rare earth element calculated as an oxide thereof, 0.5 to 8% by weight of V (vanadium) calculated as $V_2O_5$, and 0.5 to 8% by weight of at least one Va/VIa group element selected from the group consisting of Nb, Ta, Cr, Mo, and W calculated as an oxide thereof, the proportion in total of vanadium and the Va/VIa element being 1 to 10% by weight calculated as oxides;

embedding the unfired heating element into the powdery mixture;

forming into a desired shape the powdery mixture containing the heating element;

firing the shaped mixture to obtain a sintered body; and grinding the sintered body such that the connecting lead wires are partially exposed;

inserting the ceramic heater into an outer sleeve held by a cylindrical body member for attachment to a cylinder block of a diesel engine.

16. The ceramic glow plug according to claim 15 wherein the amount of said at least one rare earth element is 1 to 15% by weight calculated as an oxide thereof, the amount of V (vanadium) is 1 to 5% by weight calculated as $V_2O_5$; the amount of said at least one Va/VIa group element is 1 to 5% by weight calculated as an oxide thereof; and the proportion in total of vanadium and the Va/VIa element is 2 to 6% by weight calculated as oxides.

17. The ceramic glow plug according to claim 13 further comprising:

a metallic outer sleeve having a rear portion;

a cylindrical body member for holding the rear portion of the metallic outer sleeve; and a terminal electrode disposed in the body member in an insulated manner; wherein the ceramic heater is inserted into the metallic outer sleeve.

* * * * *

UNITED STATES PATENT AND TRADEMARK OFFICE

CERTIFICATE OF CORRECTION

PATENT NO. : 5,883,360

DATED : March 16, 1999

INVENTOR(S) : Kazuho Tatematsu and Masahiro Konishi

It is certified that error appears in the above-identified patent and that said Letters Patent is hereby corrected as shown below:

In the Claims:

Claim 2, line 1 delete the word "heat" and insert the word – heater –;

Claim 3, line 1 delete the word "heat" and insert the word – heater –;

Claim 4, line 1 delete the word "heat" and insert the word – heater –;

Claim 5, line 1 delete the word "heat" and insert the word – heater –; and

Claim 6, line 1 delete the word "heat" and insert the word – heater –.

Signed and Sealed this

Fifth Day of October, 1999

*Attest:*

*Attesting Officer*

Q. TODD DICKINSON

*Acting Commissioner of Patents and Trademarks*